US009164484B2

(12) United States Patent
Stranczl et al.

(10) Patent No.: US 9,164,484 B2
(45) Date of Patent: Oct. 20, 2015

(54) SPRUNG BALANCE FOR A TIMEPIECE

(71) Applicant: Nivarox-FAR S.A., Le Locle (CH)

(72) Inventors: Marc Stranczl, Nyon (CH); Marco Verardo, Les Bois (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 14/406,772

(22) PCT Filed: Jul. 4, 2013

(86) PCT No.: PCT/EP2013/064108
§ 371 (c)(1),
(2) Date: Dec. 10, 2014

(87) PCT Pub. No.: WO2014/016094
PCT Pub. Date: Jan. 30, 2014

(65) Prior Publication Data

US 2015/0153711 A1 Jun. 4, 2015

(30) Foreign Application Priority Data

Jul. 26, 2012 (EP) ..... 12178020

(51) Int. Cl.

| | |
|---|---|
| ***G04B 17/32*** | (2006.01) |
| ***G04B 17/34*** | (2006.01) |
| ***G04B 15/14*** | (2006.01) |
| ***G04B 17/06*** | (2006.01) |
| ***G04B 17/26*** | (2006.01) |

(52) U.S. Cl.
CPC ..... *G04B 15/14* (2013.01); *G04B 17/06* (2013.01); *G04B 17/26* (2013.01); *G04B 17/325* (2013.01); *G04B 17/34* (2013.01); *G04B 17/345* (2013.01)

(58) Field of Classification Search
CPC ..... G04B 15/14; G04B 17/06; G04B 17/26; G04B 17/325; G04B 17/34; G04B 17/345
USPC ..... 368/177, 178
See application file for complete search history.

(56) References Cited

U.S. PATENT DOCUMENTS 1,435,642 A * 11/1922 Horn ..... 368/144
2,057,642 A * 10/1936 Eddison et al. ..... 368/177
3,041,819 A 7/1962 Ensign et al.

(Continued)

FOREIGN PATENT DOCUMENTS

EP 1 818 736 A1 8/2007
EP 1 857 891 A1 11/2007

OTHER PUBLICATIONS

International Search Report issued Jul. 22, 2013, in PCT/EP2013/064108, filed Jul. 4, 2013.

*Primary Examiner* — Vit W Miska
(74) *Attorney, Agent, or Firm* — Oblon, McClelland, Maier & Neustadt, L.L.P.

(57) ABSTRACT

A timepiece assembly including a balance spring stud fixed to a plate, and a balance spring wound into coils between an inner end fixed to a collet and an outer end fixed to the balance spring stud. The balance spring stud and/or the collet includes a braking mechanism cooperating with a first coil during accelerations by contraction or expansion of the balance spring higher than set values, to modify a resulting rigidity of the balance spring when the first coil is locally coupled to the braking mechanism, arranged on a first inner lip and a second outer lip included in the balance spring stud and/or in the collet, which includes a first inner lip and a second outer lip each including the braking mechanism.

19 Claims, 3 Drawing Sheets

(56) References Cited

U.S. PATENT DOCUMENTS 3,364,673 A * 1/1968 Boult ..... 368/177
2009/0116343 A1 5/2009 Levingston
2009/0135679 A1 5/2009 Musy et al.
2010/0061192 A1 3/2010 Hessler et al.

* cited by examiner

SPRUNG BALANCE FOR A TIMEPIECE

FIELD OF THE INVENTION

The invention concerns a timepiece assembly including at least one balance spring stud comprising means of attachment to a plate or to a bridge, said assembly including at least one timepiece balance spring comprising at least one strip wound into coils between an inner end and an outer end, said inner end fixed to a collet being pivotally movable about a pivot axis, and said outer end being integral with said balance spring stud, wherein said balance spring stud and/or said collet includes braking means arranged to cooperate with at least a first coil of said coils during accelerations due to contraction or expansion of said balance spring, which are higher than set values, to modify the resulting rigidity of said balance spring when the number of active coils thereof is modified by locally coupling at least said first coil to said braking means.

The invention also concerns a timepiece movement including at least one timepiece assembly of this type.

The invention also concerns a timepiece including at least one movement of this type, and/or at least one timepiece assembly of this type.

The invention concerns the field of timepiece mechanisms, and more specifically regulating members for watches

BACKGROUND OF THE INVENTION

In mechanical watches, regulating members, in particular escapements have to satisfy several "safety" criteria. One of the safety devices, the anti-trip system, is designed to prevent the angular extension of the balance beyond a normal angle of rotation.

The technical problem is to devise a safety mechanism, particularly an anti-trip system, which limits the angle of pivoting of a balance during excessive accelerations, in particular in the event of shocks, notably for a detent escapement. The anti-trip mechanism must be capable of acting in both directions of pivoting of the balance, i.e. both during extension and contraction of the balance spring.

One solution consists in changing the geometry of the balance spring by causing the lugs of consecutive coils to cooperate in abutment, so as to render some coils inactive and thus to modify the rigidity of the balance spring and its response to impulses. A mechanism of this type, capable of limiting the angular travel of the balance in both directions of pivoting is known from EP Patent No 2 434 353 A1 in the name of MONTRES BREGUET SA, which discloses an anti-trip balance spring wherein notches pertaining to consecutive coils cooperate with each other, both during the contraction and the expansion of the balance spring.

US Patent Application No 2009/116343A1 in the name of LEVINGSTON GIDEON describes a balance spring comprising, on the outer coil thereof, a balance spring stud including two lips which can enter into contact with the balance spring during extensions or contractions which are higher than normal, and thereby modify the active length thereof.

EP Patent Application No 1857891A1 in the name of PATEK PHILIPPE describes a one-piece balance spring-collet assembly, the outer contour of the collet comprising at least one stop member with which the balance spring cooperates in abutment in the event of a shock before exceeding the elastic limit of the inner coil.

EP Patent Application No 1818736A1 in the name of the SWATCH GROUP R&D describes a shock absorber collet whose asymmetrical contour follows the inner coil of the balance spring at a substantially constant distance, said contour being able to take the form of a curve provided with discrete bearing points.

U.S. Pat. No. 3,041,819A in the name of ENSIGN, GEORGE describes a sprung balance, wherein the arm of the balance bears a pin provided with a balanced strip, said strip being arranged, according to the angular orientation thereof relative to the arm, to exert a braking force to prevent tripping. In a variant, the outer coil of the balance spring bears a unit capable of interfering with a pin carried by an arm of the balance.

It is an object of the present invention to improve safety, while only very slightly disturbing the inertia of the balance, by limiting the angular travel thereof in both directions of rotation.

SUMMARY OF THE INVENTION

To this end, the invention concerns a timepiece assembly including at least one balance spring stud comprising means of attachment to a plate or to a bridge, said assembly including at least one timepiece balance spring comprising at least one strip wound into coils between an inner end and an outer end, said inner end fixed to a collet being pivotally movable about a pivot axis, and said outer end being integral with said balance spring stud, wherein said balance spring stud and/or said collet includes braking means arranged to cooperate with at least a first coil of said coils during accelerations due to contraction or expansion of said balance spring, which are higher than set values, to modify the resulting rigidity of said balance spring when the number of active coils thereof is modified by locally coupling at least said first coil to said braking means, characterized in that said collet includes at least a first inner lip and at least a second outer lip each comprising said braking means, and in that said braking means are arranged on at least a first inner lip and at least a second outer lip comprised, respectively, in said balance spring stud and/or in said collet.

According to a characteristic of the invention, said timepiece assembly includes a sprung balance assembly comprising at least one balance pivoting about said axis and to which is fixed said inner end or said outer end of a said balance spring, and the amplitude of pivoting of said balance is less than 360°.

The invention also concerns a timepiece movement including at least one timepiece assembly of this type.

The invention also concerns a timepiece including at least one movement of this type, and/or at least one timepiece assembly of this type.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
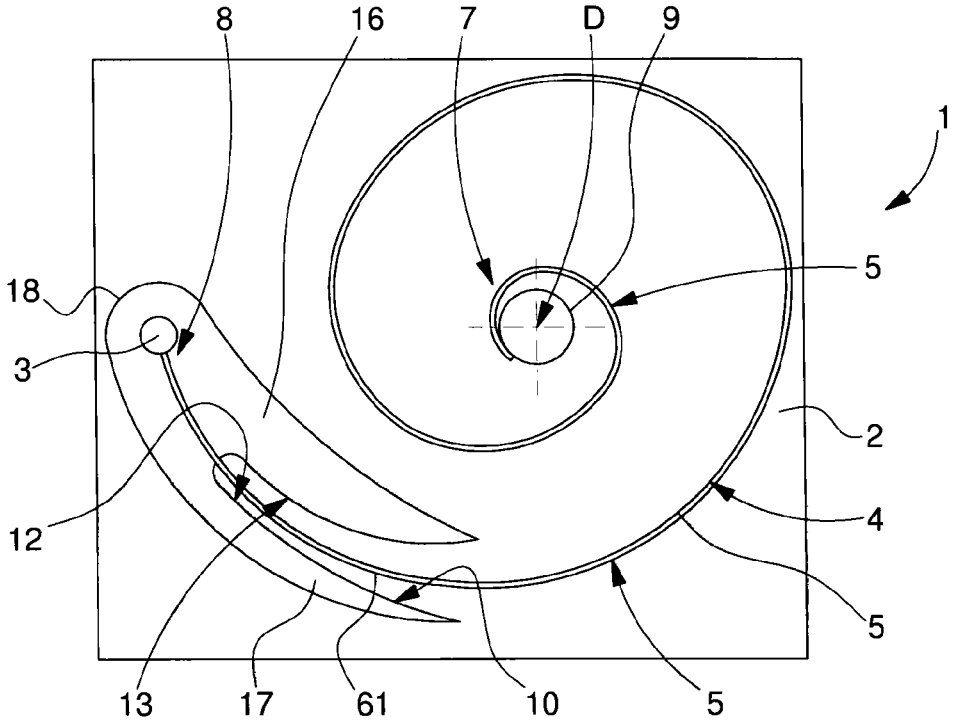
FIG. 1 shows a schematic plan view of a timepiece assembly according to the invention, comprising a balance spring intended to oscillate about a pivot axis and attached by the outer end thereof to a balance spring stud, which comprises braking means arranged to modify the resulting rigidity of the balance spring in the event of higher than normal amplitude, which may be caused by a shock or by an impulse that is too great, when a coil of the balance spring comes into contact with the braking means; said braking means are featured in a variant wherein the balance spring stud includes an inner lip and an outer lip, each comprising a convex and respectively concave friction path.

The invention concerns the field of timepiece mechanisms, and more specifically regulating members for watches It is an object of the invention to improve the safety of an oscillating mechanism or energy storage mechanism, comprising a balance spring, in particular a sprung balance mechanism.

The principle adopted is that of modifying the resulting rigidity of the spring in the event of higher than normal amplitude, which may be caused by a shock or an impulse that is too great, when an incident occurs in conditions of use which differ from normal operation, and particularly during high accelerations or a shock.

Modifying the rigidity of the balance spring may have other applications, and this specification, which concerns a preferred application of this invention to the anti-trip system of an escape mechanism, is in no way restrictive.

The object of application to a sprung balance is to limit the angle of rotation of the balance, in mechanical watches, to a given angle, in particular for amplitudes higher than 360°. The angular travel limit is achieved in both directions of rotation without modifying the inertia of the balance. The sprung balance is said to be "free" during its normal angular travel (with respect to the anti-trip system) due to the fact that said system does not cause any shocks during the normal movement of the sprung balance.

The principle of the proposed system relies on a modification of the geometry of the balance spring. During the extension or contraction of the balance spring due to rotation of the balance, a relative angular and radial motion occurs between the coils.

The system described above limits the number of active coils according to the angle of rotation, and according to the movement of the coils. The rigidity of the balance spring can thus be momentarily modified according to the angle of rotation.

The timepiece assembly 1 described here has a stop system based on the absolute radial movement of balance spring 4. The application thereof concerns the first outer coil or coils of the balance spring.

A careful design ensures that the centre of gravity of the balance spring is balanced. The geometry, distribution, position and number of stop surfaces require a detailed design and this document merely summarizes the principle.

The manufacture of this type of balance spring relies on micro-manufacturing methods allowing a large degree of planar design freedom. It is possible to make this type of balance spring using silicon technology. The present invention is not limited to this technology, "LIGA" methods and other micro-manufacturing methods currently used for timepiece components, and in particular escape mechanisms, may be used.

The invention concerns a timepiece assembly 1. It includes at least one balance spring stud 3 comprising means of attachment to a plate 2 or a bridge.

Assembly 1 includes at least one timepiece balance spring 4 which in turn includes at least one strip 5 wound into coils 6 between an inner end 7 and an outer end 8. The inner end 7 is attached to a collet 9 and is pivotally movable about a pivot axis D, and the outer end 8 is integral with balance spring stud 3.

Balance spring stud 3 and/or collet 9 includes braking means 10. These means 10 are arranged to cooperate with at least a first coil 61 of coils 6, during accelerations due to contraction or extension of balance spring 5 which are higher than set values, to modify the resulting rigidity of balance spring 4. This modification of rigidity results from modification of the number of active coils of balance spring 4 by locally coupling at least said first coil 61 to braking means 10. It is understood that the fact that a coil is coupled to another, or several others, for example the adjacent inner coil and/or the adjacent outer coil, cancels out the effect of that coil or those coils, and modifies the resulting characteristics of the entire balance spring 4.

According to the invention, collet 9 includes at least a first inner lip 96 and at least a second outer lip 97 each including such braking means 10. These braking means 10 are arranged on at least a first inner lip 16, 96 and at least a second outer lip 17, 19 comprised, respectively, in balance spring stud 3 and/or collet 9.

Balance spring stud 3 is therefore a stop stud which preferably acts on the outer coil or the outer coils of balance spring 4. This stop is based on an entirely radial movement of the balance spring, when it concerns the outermost coil of the balance spring; indeed, the attachment of the balance spring to the balance spring stud leaves the balance spring little possibility of elongation, and most of the deformation is radial with respect to axis D.

Figure 4:
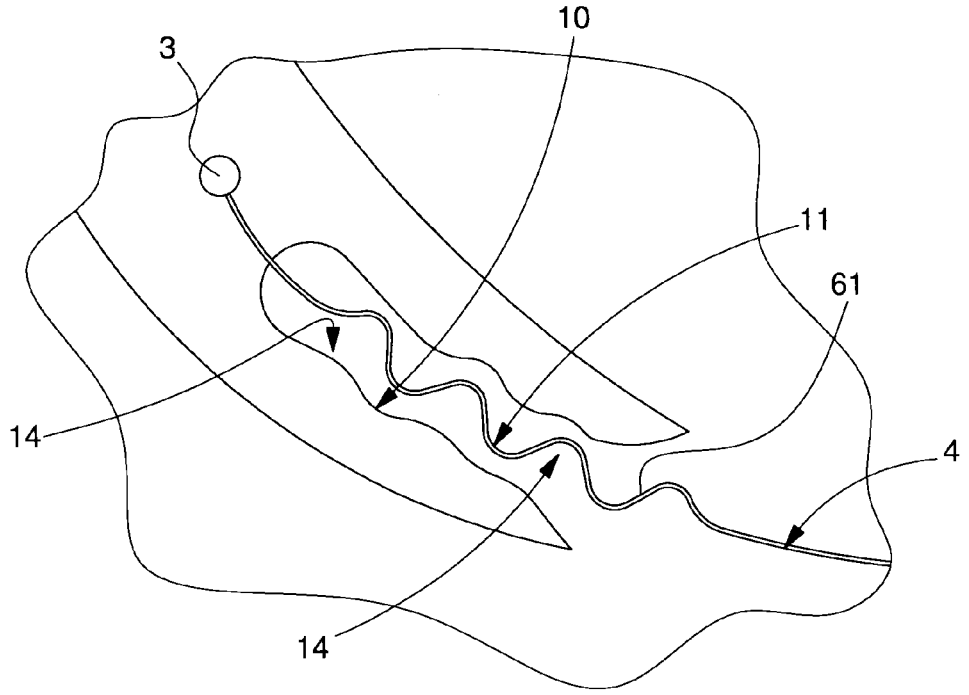
FIG. 4 shows a schematic view similar to FIG. 1 of a detail of another variant wherein the balance spring includes complementary friction means such as an embossed portion of the balance spring, intended to cooperate with friction surfaces in relief comprised in an inner lip and an outer lip.

In a particular embodiment, as seen in FIG. 4, braking means 10 are arranged to cooperate with complementary friction means 11 comprised in at least the first coil 61. The braking means and/or the friction means 11 may be arranged in different ways: high surface roughness, surface coating with a high friction coefficient, embossed or grooved or stamped surface of balance spring 4, although these economical embodiment examples are non-limiting.

Thus, in a variant, the complementary friction means 11 are formed by an embossed or grooved or stamped surface of balance spring 4.

In another variant, braking means 10 include at least one friction surface 14 arranged to cooperate with a complementary friction surface 15 comprised in complementary friction means 11.

In an advantageous variant embodiment seen in FIG. 1, braking means 10 include at least one substantially helical concave friction path 12, which is arranged to receive in abutment the outer part of at least one coil 6 when said coil extends during an acceleration beyond the set value.

In an advantageous variant embodiment also shown in FIG. 1, braking means 10 include at least one substantially helical convex friction path 13, which is arranged to receive in abutment the inner part of at least one coil 6 when said coils contracts during an acceleration beyond the set value.

In a variant also illustrated in FIG. 1, balance spring stud 3 includes at least a first inner lip 16 and at least a second outer lip 17 each including braking means 10.

In a variant, timepiece assembly 1 includes a plate 2 carrying balance spring stud 3, said plate 2 includes at least a first inner lip 16 and at least a second outer lip 17 each including braking means 10.

Figure 2:
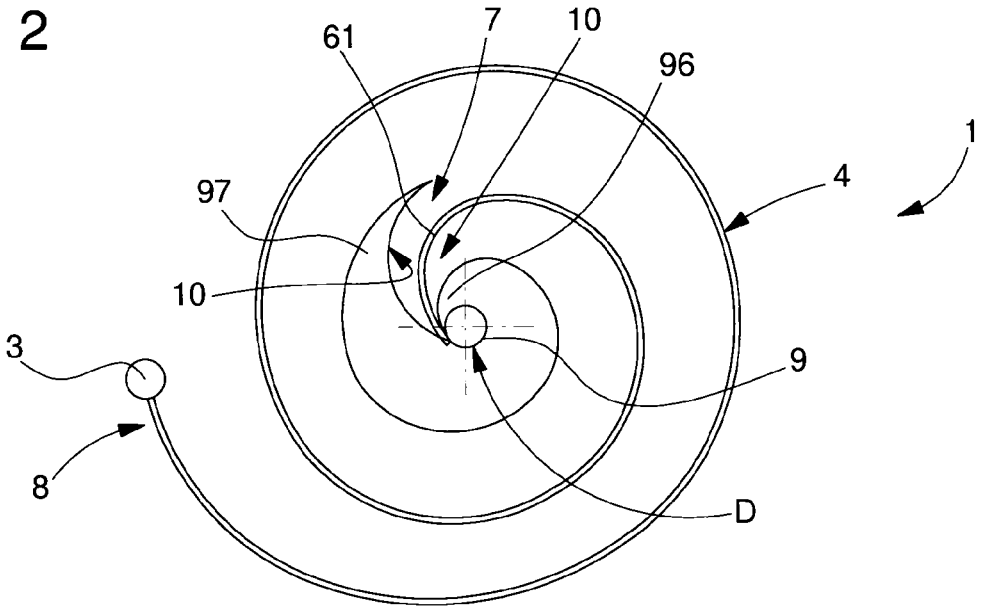
FIG. 2 shows a schematic view similar to FIG. 1 of another variant of the timepiece assembly wherein similar braking means are arranged in proximity to the inner coil of the balance spring, integral with a collet for attachment to the balance.

In the variant of FIG. 2, collet 9 includes at least a first inner lip 96 and at least a second outer lip 97 each including braking means 10.

The invention is advantageously provided for a timepiece assembly 1 including a balance 21 bearing collet 9. According to this variant, balance 21 includes at least a first inner lip 96 and at least a second outer lip 97 each including braking means 10. In a particular embodiment, balance 21 forms a one-piece assembly with collet 9 and said at least one first inner lip 96 and at least ons second outer lip 97. First inner lip 96 and second outer lip 97 rotate with balance 21 and are therefore integral, either with collet 9, or with balance 21 in the case where collet 9 and balance 21 are separate components.

In these embodiments with lips, advantageously balance spring stud 3 and/or collet 9 carries a first inner lip 16, 96 bearing convex friction path 13 and/or a second outer lip 17, 97 bearing concave friction path 12.

In a particular embodiment where balance spring stud 3 and/or collet 9 are arranged to participate in the damping of any shock, balance spring stud 3 and/or collet 9 carries at least a first inner lip 16, 96 and at least a second outer lip 17, 97, each including braking means 10 and first inner lip 16, 96 and/or second outer lip 17, 97 is flexible.

In a particular embodiment, balance spring stud 3 carries at least a first inner lip 16 and at least a second outer lip 17 each including braking means 10 and first inner lip 16 and/or second outer lip 17 pivots with respect to balance spring stud 3 or is fixed to a plate 18 that pivots with respect to balance spring stud 3. This pivoting assembly can be braked, either by friction, or preferably by the return action of an elastic return means, spring or suchlike. In a particular embodiment made of micromachinable material, each of these lips may conveniently be made to pivot by elastic bending.

In a variant allowing for adjustment, the first inner lip 16 and/or the second outer lip 17 pivots with respect to balance spring stud 3 or is fixed to a plate 18 that pivots with respect to balance spring stud 3.

In the variant with a plate, the first inner lip 16 and/or the second outer lip 17 may be pivotally mounted with respect to plate 2.

In a variant, balance spring stud 3 is fixed with respect to a plate 2 which is comprised in or affixed to assembly 1.

In another variant, balance spring stud 3 is fixed to a stud holder, which is movable with respect to a plate 2 comprised in or affixed to assembly 1.

Figure 3:
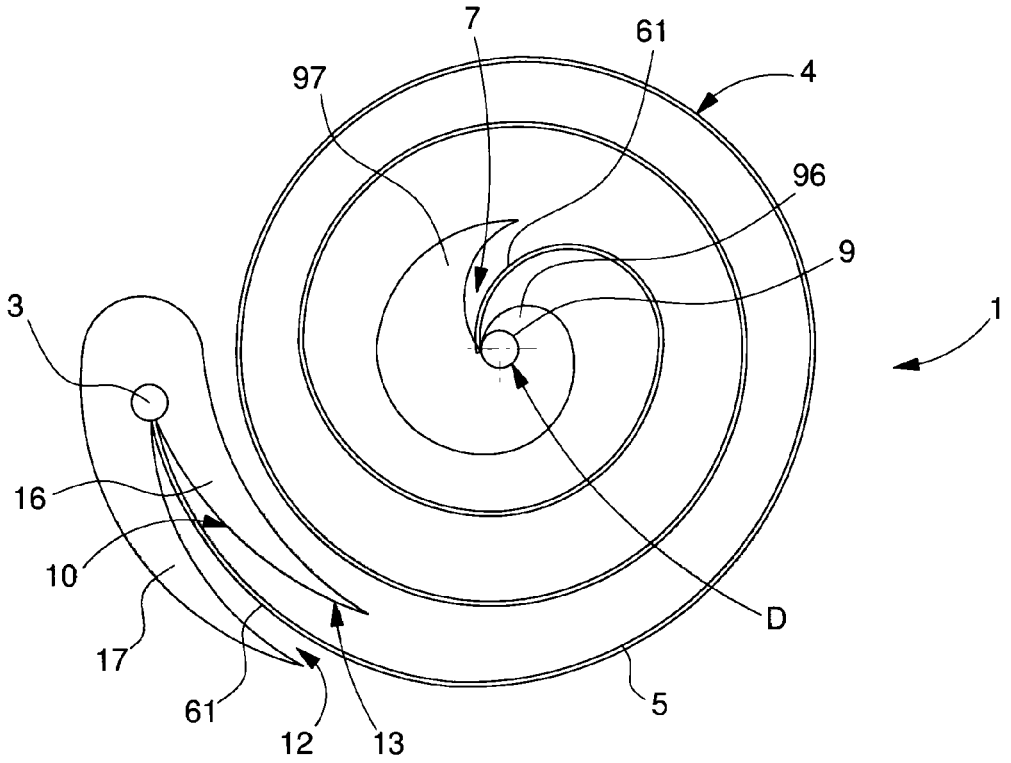
FIG. 3 shows a schematic view of the combination of the embodiments of FIGS. 1 and 2.
Figure 5:
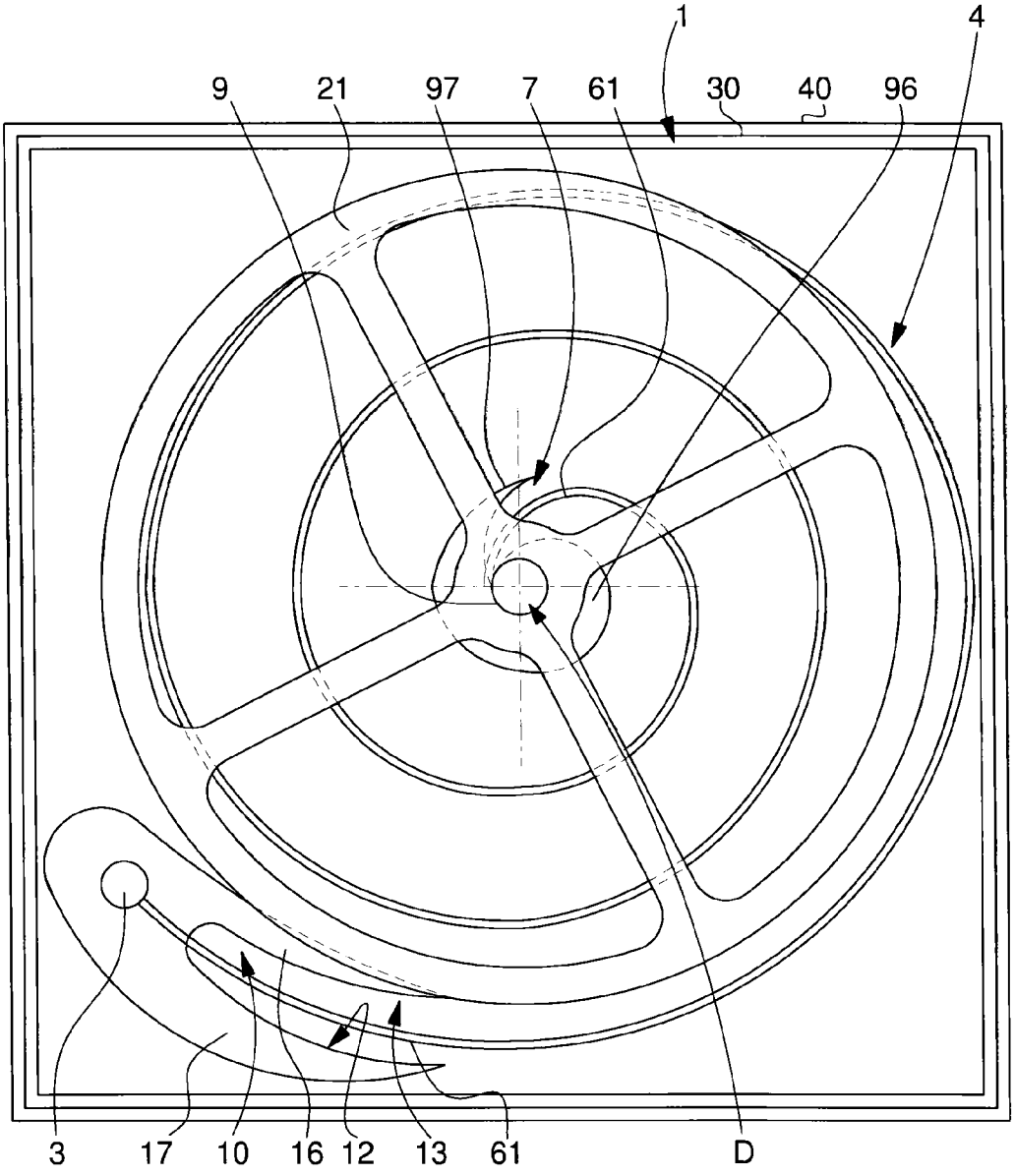
FIG. 5 shows a block diagram of a timepiece, particularly a watch, comprising a movement which includes a timepiece assembly according to the variant of FIG. 3, and wherein the balance spring is attached, by a collet, at the inner end thereof, to a balance.

FIGS. 3 and 5 show an assembly 1 wherein means 10 are disposed facing both the innermost coil 7 and the outermost coil 8 of balance spring 4. The numbering of the first coil 61 is maintained in each case: this first coil 61, which is in fact a local fraction of a coil, is a portion of balance spring 4 which plays the same particular role during a shock, this is why the numbering is identical, despite the different positions.

The invention also concerns a timepiece assembly 1, which includes a sprung balance assembly 20 including at least one balance 21 pivoting about axis D and to which is fixed, by a collet 9, the inner end 7 of a balance spring 4 and, according to the invention, the amplitude of pivoting of the balance is less than 360°.

In a particular variant embodiment, balance spring stud 3 and balance spring 4 form a one-piece assembly made of micromachinable material. Preferably, balance spring 4 then includes at the inner end 7 thereof a collet 9 for attachment to a balance staff. In such an embodiment, the balance spring stud and balance spring can be made in the same single layer.

In another particular variant, balance spring stud 3 and balance spring 4 and a balance 21 form a one-piece assembly made of micromachinable material. This one-piece assembly may be made in a particular, but non-limiting manner, from an SOI wafer comprising two layers of silicon, one for balance 21, and the other for balance spring stud 3 and balance spring 4, separated by a layer of oxide equivalent to the functional play required between the balance spring and the balance. It may also be made with three layers of silicon separated by two layers of oxide, the intermediate silicon layer and the two oxide layers then defining together the value of this functional play.

Naturally, the invention is applicable to the case of a balance provided with several balance springs, or inversely; the number of layers of the wafer is then modified accordingly. Advantageously, when, for example, two balance springs are arranged on each side of a median balance, each balance spring is surrounded by a balance spring stud including limit stop surfaces as described above.

The invention also concerns a timepiece movement 30 including at least one such timepiece assembly 1.

The invention also concerns a timepiece 40 incorporating at least one such movement 30, and/or at least one such timepiece assembly 100.

The system has the advantage of limiting the travel of the balance in both directions of rotation. This limit is achieved by modifying the rigidity of the balance spring. This modification of rigidity may be adapted by the choice of the number and distribution of the stop surfaces incorporated in the balance spring or in the balance spring stud or in the plate.

The inertia of the sprung balance system is only modified by the modification of the inertia of the balance spring. The anti-trip system does not disturb the normal oscillations of the sprung balance; it only affects the operation thereof when the amplitude of rotation is exceeded.

The invention claimed is:

1. A timepiece assembly comprising:

at least one balance spring stud including an attachment to a plate or to a bridge;

at least one timepiece balance spring including at least one strip wound into coils between an inner end and an outer end, said inner end fixed to a collet being pivotally movable about a pivot axis, and said outer end being fixed to said balance spring stud;

wherein at least one of said balance spring stud and said collet includes a braking structure arranged to cooperate with at least a first coil of said coils during accelerations due to contraction or extension of said balance spring which are higher than set values, to modify a resulting rigidity of said balance spring when a number of active coils thereof is modified by locally coupling at least said first coil to said braking structure;

wherein said collet includes at least a first inner lip and at least a second outer lip each including said braking structure.

2. The timepiece assembly according to claim 1, wherein said braking structure is arranged to cooperate with a complementary friction surface included in at least said first coil, said complementary friction surface being formed by an embossed or grooved or stamped surface of said balance spring, or by a surface having a high surface roughness, or by a surface including a surface coating with a high friction coefficient.

3. The timepiece assembly according to claim 2, wherein said braking structure includes at least one friction surface arranged to cooperate with a complementary friction surface included in said complementary friction surface.

4. The timepiece assembly according to claim 1, wherein said braking structure includes at least one substantially helical concave friction path arranged to receive in abutment an outer portion of at least one said coil during the extension thereof in an acceleration beyond said set value.

5. The timepiece assembly according to claim 1, wherein said braking structure includes at least a substantially helical convex friction path arranged to receive in abutment an inner portion of at least one said coil during the contraction thereof in an acceleration beyond said set value.

6. The timepiece assembly according to claim 1, wherein said balance spring stud includes at least a first inner lip and at least a second outer lip each including said braking structure.

7. The timepiece assembly according to claim 1, further comprising a plate carrying said balance spring stud, said plate includes at least a first inner lip and at least a second outer lip of said balance spring stud, each including said braking structure.

8. The timepiece assembly according to claim 1, further comprising a balance carrying said collet, said balance includes at least said first inner lip and at least said second outer lip each including said braking structure, said balance forming a one-piece assembly with said collet and said at least one first inner lip and at least one second outer lip.

9. The timepiece assembly according to claim 4, wherein said braking structure includes at least a substantially helical convex friction path arranged to receive in abutment the inner portion of at least one said coil during the contraction thereof in an acceleration beyond said set value, and wherein at least one of:

said balance spring stud carries a first inner lip carrying said convex friction path, and carries a second outer lip carrying said concave friction path, and said collet carries said first inner lip carrying said convex friction path, and carries said second outer lip carrying said concave friction path.

10. The timepiece assembly according to claim 1, wherein at least one of:

said balance spring stud carries at least a first inner lip and at least a second outer lip, each including said braking structure, and wherein at least one of said first inner lip and said second outer lip is flexible, and said collet carries at least said first inner lip and at least said second outer lip, each including said braking structure, and wherein at least one of said first inner lip and said second outer lip is flexible.

11. The timepiece assembly according to claim 1, wherein said balance spring stud carries at least a first inner lip and at least a second outer lip, each including said braking structure, and wherein at least one of said first inner lip and said second outer lip pivots with respect to said balance spring stud or is fixed to a plate which pivots with respect to said balance spring stud.

12. The timepiece assembly according to claim 11, wherein at least one of said first inner lip and said second outer lip of said balance spring stud pivots with respect to said balance spring stud.

13. The timepiece assembly according to claim 1, wherein said balance spring stud is fixed with respect to a plate included in or affixed to said assembly.

14. The timepiece assembly according to claim 1, wherein said balance spring stud is fixed to a balance spring stud holder which is movable with respect to a plate included in or affixed to said assembly.

15. The timepiece assembly according to claim 1, wherein said balance spring stud and said balance spring form a one-piece assembly made of micromachinable material, said balance spring including at an inner end thereof a said collet for attachment to a balance staff.

16. The timepiece assembly according to claim 1, wherein the assembly includes a sprung balance assembly including at least one balance pivoting about said axis and to which is fixed by said collet said inner end of said balance spring, wherein an amplitude of pivoting of said balance is less than 360°.

17. The timepiece assembly according to claim 16, wherein said balance spring stud and said balance spring and said balance form a one-piece assembly made of micromachinable material.

18. A timepiece movement including at least one timepiece assembly according to claim 16.

19. A timepiece including at least one movement according to claim 18.

* * * * *